United States Patent [19]

Bühler et al.

[11] 4,150,818

[45] Apr. 24, 1979

[54] COOLING ELEMENT FOR A METALLURGICAL FURNACE

[75] Inventors: Hans-Eugen Bühler, Rheurdt; Günter Robusch, Essen; Herbert Schäfer, Dinslaken; Karl-Heinz Peters, Duisburg, all of Fed. Rep. of Germany

[73] Assignee: Thyssen Aktiengesellschaft vorm. Augus Thyssen-Hütte, Duisburg, Fed. Rep. of Germany

[21] Appl. No.: 896,794

[22] Filed: Apr. 17, 1978

[30] Foreign Application Priority Data

Apr. 21, 1977 [DE] Fed. Rep. of Germany ..... 2717641
Apr. 29, 1977 [DE] Fed. Rep. of Germany ..... 2719166

[51] Int. Cl.[2] ..... C21B 7/10
[52] U.S. Cl. ..... 266/193
[58] Field of Search ..... 122/6 A, 6 B; 266/190, 266/193, 194

[56] References Cited

U.S. PATENT DOCUMENTS 3,706,343 12/1972 Saiga et al. ..... 266/193
4,004,790 1/1977 Krol et al. ..... 266/193

FOREIGN PATENT DOCUMENTS 4826564 7/1969 Japan ..... 266/193

*Primary Examiner*—Gerald A. Dost
*Attorney, Agent, or Firm*—J. Harold Nissen

[57] ABSTRACT

A cooling element for a metallurgical or blast furnace having steel tubes integrally cast into a cast iron body to convey a cooling medium. The steel tubes are provided with an additional metallic layer which is composed of Ni, Co, Mn, Ag either individually or as a combination of one or more thereof and a metallic oxide layer composed of one or more metallic oxides provided on the metallic layer. The metallic oxide layer has a free oxide standard enthalpy of formation of less than −145kcal with normal pressure conditions and a temperature of 600° C.

14 Claims, 2 Drawing Figures

COOLING ELEMENT FOR A METALLURGICAL FURNACE

CROSS REFERENCES TO RELATED APPLICATION

The invention disclosed in this application is related to the invention disclosed in application Ser. No. 896,795, filed Apr. 17, 1978 in the name of Hans-Eugen Bühler et al. which is based on W. German Patent Application P No. 2719165.7, filed Apr. 29, 1977.

BACKGROUND OF THE INVENTION

This invention relates to cooling elements for a metallurgical furnace, and in particular a blast furnace.

More particularly, the invention is concerned with cooling elements for the aforesaid furnaces provided with integrally cast steel tubes in the cast iron body. The steel tubes are provided to convey the cooling means or medium.

DESCRIPTION OF THE PRIOR ART

These steel tubes are conventionally provided with an additional metallic layer.

Specifically, a cooling element of the aforementioned type is disclosed in the introduction in an earlier W. German Patent Application, the German Offenlegungsschrift No. 2,128,827 (on page 2, second paragraph). The metallic layer in this prior known cooling element is composed of aluminum, copper or tin. It is specified in the aforementioned Offenlegungsschrift that carburization of the steel tube can not be avoided with the prior known cooling element. Such a carburization impairs the toughness properties of the steel tube, so that the danger of cracking or at least the susceptibility to cracking is increased.

It should be noted that these cooling elements are subjected to high stresses and strains. Specifically, it must be taken into consideration that these cooling elements are primarily used to cool the inner brickwork of a shaft furnace, especially the blast furnace. These cooling elements have a refractory lining on the side facing the inside or interior of the furnace. The cooling elements maintain these low temperatures. The cooling elements are exposed to heavy thermo-mechanical stress when in use. Unfortunately, the heretofore known cooling elements have an unsatisfactory period of use as they are susceptible to cracks and are not thermoshock-resistant. The susceptibility to cracks can originate at the steel tube or at the cast iron body or in both places. The susceptibility of the steel tube to cracking is due to carbon diffusing out of the liquid cast iron body into the steel tube. The diffusion of the carbon may happen especially as long as the cast iron, which is already cast and is forming the cast iron body, has not yet solidified. Under these conditions the carbon has the highest chance to diffuse from the liquid cast iron (surrounding the steel tubes) into the steel tubes. The prior known proposal to protect the steel tube by means of a metallic aluminum layer has proved a failure as the metallic aluminum layer was already affected when the cast iron body was being cast. The cohesive metallic layer was broken open so that a disadvantageous carburization of the steel tubes could ensue. The alternative proposal in the aforementioned German Offenlegungsschrift No. 2,128,827 to apply a metallic oxide coating to the steel tubes instead of the metallic coating is also unsatisfactory. The metallic oxide layer applied to the steel tube is frequently not thermoshock-resistant, i.e. on casting and in operation cracks are caused in the metallic oxide layer due to the different coefficients of expansion of the steel tube and the oxide layer.

In addition, the cooling elements are susceptible to damage due to cracks occurring in the cast iron body. The prior art known cast iron body is composed of cast iron with lamellar graphite; and, this lamellar graphite expands with increasing temperature at variance with the steel tube, so that the conduction of heat to the cooling steel tubes worsens in the course of time. Moreover, if the refractory brickwork is progressively stripped, a direct attack of the burdening of the blast furnace can occur on the front side of the cast iron body. This burdening of the blast furnace is composed of coke, partly reduced ore and slag scars. These constituent parts exert a combined thermo-mechanical stress on the cooling elements, and such stresses are revealed in the cooling element itself by displaying or exhibiting an increased susceptibility to cracking.

It is therefore an object of the present invention to develop a cooling element which has a longer working life and, in particular, overcomes the problem of susceptibility to cracking.

SUMMARY OF THE INVENTION

The present invention proposes to solve the aforesaid problems to provide a cooling element which is provided with a metallic layer different from the prior art, and which metallic layer is composed of one or more metals such as nickel, cobalt, manganese, or silver used either individually or as a combination of several thereof as an alloy, and which cooling element additionally includes a metallic oxide layer of one or several metallic oxides and which is provided on the metallic layer. The metallic oxides of this layer must be stable, i.e. the free oxide standard enthalpy of formation should be less than −145 kcal with normal pressure conditions and a temperature of 600° C.

As a stable metallic oxide, chromium oxides have been found to be useful.

However, particularly preferred are the highly stable metallic oxides, i.e. metallic oxides whose standard enthalpy of formation lies below −180 kcal with a temperature of 600° C. and with normal pressure. Thus, oxides of the metals: aluminum, titanium, zirconium are particularly preferred.

The metals, or their metallic alloys, which are chosen for the metallic layer are selected because they do not form metallic carbides or are not inclined either in the production of the cooling element or in the later use thereof to form metallic carbides. The metallic layer is preferably applied to the steel tube with a thickness in the range of 40 to 100 microns. The metallic oxide layer is then preferably applied to the metallic layer with a thickness in the range of 30 to 100 microns. The metallic layer and the metallic oxide layer should have a total thickness of 200 microns at maximum. A total layer thickness of 100 to 200 microns, in particular of 100 to 150 microns, is preferred. This layer thickness still guarantees a sufficient transfer of heat between the cooled steel tube and the cast iron body.

According to a particularly preferred embodiment, the cast iron body is composed of low alloyed cast iron with nodular graphite. For expedience, the silicon content of the nodular graphite should amount to at least 1.8% by weight, preferably at least 2.1% by weight. The silicon content can amount to 5.3% at maximum.

The preferred silicon content amounts to 2.5% to 3.5% by weight. The carbon content of the cast iron with nodular graphite amounts for expedience to 2.5% to 4.0% by weight, in particular to 2.7% to 3.8% by weight.

Advantages of the cooling elements according to the invention are that they are distinguished by long life, low susceptibility to cracking and good cooling effect. The multilayered intermediate layer formed from the metallic layer and metallic oxide layer with the components as set forth heretofore and placed between the cast iron body and the steel tube provides good protection for the steel tube even when very thinly applied. The protective function of the steel tube is guaranteed from the outset. In the production of the cooling element, i.e. casting the steel tube integrally with the cast iron body, the metallic oxide layer prevents the steel tube from being caked onto the cast iron body. The metallic oxide layer also supports the metallic layer in its protective function as it prevents the diffusion of both carbon and oxygen into the steel tube. As the metallic layer remains undamaged, it can effectively protect the steel tube against carburization. The choice of metals also serves an important function to prevent cracking. With the prior known cooling element, cracks in the steel tubes of the cooling element are already created during the production thereof. This is because the correct metals for the metallic layer according to the teachings of this invention were not chosen, and the metallic layer was damaged during its production.

Another advantage of the invention is the use of nodular graphite for the cast iron body. The nodular graphite is effective to increase the working life of the cooling element. The inventors believe that one reason for the longer working life may be explained thereby that cooling elements having a cast iron body of nodular graphite show less susceptibility for cracking than the preknown cooling elements which have a cast iron body with lamellar graphite. The known cooling elements which are composed of cast iron with lamellar graphite are noted for and have a high thermal conductivity, but have much less wear-resistant and are more susceptible for cracking than cast iron with nodular graphite.

While cast iron with nodular graphite may have a lower thermal conductivity, which is still impaired with an increasing silicon content, these cumulating unfavourable effects do not cause problems for the cooling element applied for. The reason is the improved heat transfer (or cooling effect) from the nodular cast iron body to the steel tubes conveying the cooling medium. According to the invention there is a close contact (only short distance) between steel tube and the nodular cast iron body due to the thin multilayered intermediate layer.

It must be taken into consideration that only a part of the multilayered intermediate layer has a detrimental effect to the heat transfer when heat is transmitted through the layer. It is only a thin metallic oxide layer which should be considered for a detrimental effect whereas according to one alternative of the prior art the metallic oxide layer calls for the complete thickness of the intermediate layer. The only factor which may be considered to be responsible for an unfavorable heat transfer is the thickness of the metallic oxide layer and not the additional metallic layer of the multilayered intermediate layer. Therefore, an effective gap width of less than 100 microns which corresponds to the thickness of the metallic oxide layer is the total provided which may cause the unfavorable heat transfer and this is minimal.

The cooling element according to the invention with the cast iron body composed of nodular graphite has the great advantage that the cast iron body has a high consistency in growth. This high consistency in growth promotes the close contact between the steel tubes and the cast iron body and provides the advantage that the refractory lining has a better hold in the cast iron body. It must be considered that the improved consistency in growth of the cast iron body composed of nodular graphite is further promoted by the improved cooling effect in the cooling elements according to the invention so that movements of the cooling element are greatly reduced in the area where the refractory brickwork is anchored. The refractory brickwork is therefore better anchored in the cooling element according to the invention. However, even if the refractory brickwork has been stripped down to the front surface of the cooling element, the cast iron body of nodular graphite exhibits advantages as the cooling elements according to the invention can withstand the thermo-mechanical stresses better than prior known constructions.

In summary, it should be noted that the thin intermediate layer provides for a cooling effect which enables the cooling element to be maintained at a lower temperature despite any inferior heat conductivity of the cast iron alloy formed with nodular graphite. At the same time, the intermediate layer provides the possibility to produce the cooling element at relatively high casting temperatures, as are necessary when casting cast iron with nodular graphite. As already explained in the introduction part the diffusion of carbon increases exponentially with increasing casting temperatures so that the danger of a carburization will increase with higher casting temperatures. It has been proved that following the teaching of the invention even with these higher production temperatures, the steel tubes which are cast integrally in the cooling element are effectively protected by the multi-layered intermediate layer against the disadvantageous carburization.

In addition to the essential alloy elements of carbon, silicon and the nodular graphite-forming elements magnesium or cerium or both, the cast iron body may also contain alloying elements which have advantageous effects on the desired properties of the cooling element. It has been shown that a high proportion of ferrite in the structure of the cast iron body is advantageous, as a high ferrite proportion leads to the steel tube and the cast iron body both having substantially the same thermal expansion behavior. This is essential in order to obtain a small gap width between the steel tube and the cast iron body. Thus, the proportion of ferrite should preferably be more than 80% and in particular more than 90%. These proportions of ferrite should be present in the structure of the cooling element in cast state. Here, a molydenum content of up to 3.0% and in particular preferably from 0.5% to 1.5%, has proved expedient. Molybdenum has a ferritizing effect. The high proportion of ferrite also has a positive effect on the expansion values. The higher expansion values are jointly responsible for the reduced susceptibility to cracking. The content of manganese in the cast iron alloy should if possible not exceed 0.8%. Proportions of less than 0.5% of manganese are preferred, as such low proportions have a favorable effect on the structure.

Other objects, advantages and the nature of the invention will become readily apparent from the detailed description of the preferred embodiment taken in connection with the drawing.

DESCRIPTION OF THE PREFERRED EMBODIMENT

Figure 1:
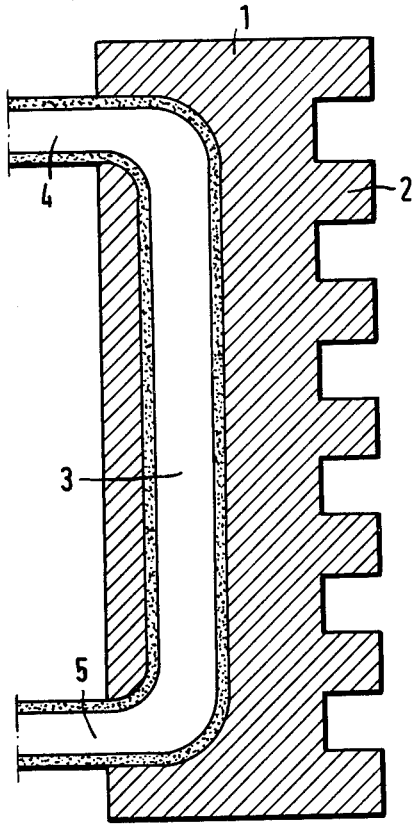
FIG. 1 is a cross-sectional view taken through a cooling element according to the invention; and, FIG. 2 shows an enlarged portion of the sectional view shown in FIG. 1.
Figure 2:
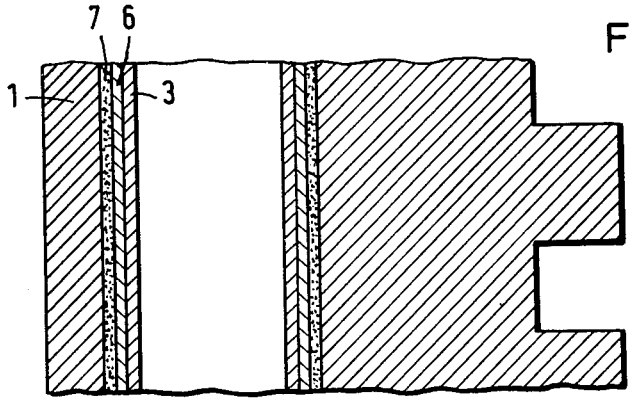

In FIGS. 1 and 2, a cooling element according to the invention is shown which includes a cast iron body 1 formed with nodular graphite having ribs 2 on one side thereof and on the other side thereof steel tubes 3 through which the cooling medium is moved. Steel tubes 3 and cast iron body 1 are integrally cast, and the tubes 3 each include an inlet 4 and an outlet 5 for the cooling medium positioned on the side opposite to ribs 2.

Cast iron body 1 is shown as a rectangular cast iron body and holds several steel tubes 3 for conveying the cooling means. The cross-section as taken through the cooling element shown in FIG. 1 only portrays one of these steel tubes 3. Cast iron body 1 is cast from cast iron with nodular graphite, has its ribs 2 pointing or directed towards the inside of the blast furnace and serves to anchor the refractory material, not shown. Steel tubes 3 are curved in a "U" shape and are cast integrally in the cast iron body 1. The inlets and outlets 4, 5 of the steel tubes 3 each project out of the cast iron body 1 on the side opposing the ribs 2.

Referring more particularly to FIG. 2, the two layer intermediate layer is shown in an enlarged view. A first, metallic layer 6 is placed directly onto the outer periphery of tube 3, and a second layer 7 of highly stable oxides is placed onto the first, metallic layer 6.

An example of a cooling element having the structure shown in FIG. 2 and including the components according to the invention is set forth as follows:

A two-layer intermediate layer is arranged between the steel tube 3 and the cast iron body 1 which is composed of nodular graphite. A preliminary layer 6 of nickel is arranged directly on the steel tube 3, and the layer 6 is approximately 70 microns thick. A second layer 7 of $Al_2O_3$ is situated on this first layer 6. The second layer is 50 microns thick.

The analysis of the cast iron body 1 was as follows: 2.8% carbon, 2.5% silicon, 0.19% manganese, 0.064% Mg, 0.014% P, 0.004% S, the remainder being iron. The tensile strength amounted to 404 $N/mm^2$ and the expansion to $\delta 5 = 10\%$.

While there has been shown and described what is considered to be a preferred embodiment of the invention, it will be obvious that various changes and modifications may be made therein without departing from the scope of the invention.

We claim:

1. In a cooling element for a metallurgical furnace provided with steel tubes to convey a cooling medium, in which the steel tubes are integrally cast into a cast iron body with a metallic layer thereon, and in which the improvement comprises:

a combination of a metallic layer and a stable metallic oxide layer;

said metallic layer being composed of a metal selected from the group consisting essentially of Ni, Co, Mn and Ag, either individually or including two or more; and said metallic oxide layer having a free oxide standard enthalpy of formation of less than −145 kcal with normal pressure conditions and a temperature of 600° C.

2. The cooling element according to claim 1, wherein said metallic oxide layer is selected from the group consisting of an oxide of the metals Al, Ti, Zr or mixtures thereof.

3. The cooling element according to claim 1, wherein said metallic layer and said metallic oxide layer together form an intermediate layer having a maximum thickness of 200 microns.

4. The cooling element according to claim 1, wherein said cast iron body is composed of low alloyed cast iron with nodular graphite.

5. The cooling element according to claim 1, wherein said cast iron has a silicon content of at least 1.8% silicon.

6. The cooling element according to claim 1, wherein said iron body contains the following constituent alloy elements:

2.5 to 4% carbon, 2.1 to 5.3% silicon, and magnesium or cerium or both as nodular graphite-forming elements.

7. The cooling element as claimed in claim 1, wherein said metallic layer is Ni.

8. The cooling element as claimed in claim 1, wherein said metallic layer is Co.

9. The cooling element as claimed in claim 1, wherein the thickness of said metallic layer is between 40 and 100 microns.

10. The cooling element as claimed in claim 1, wherein said metallic oxide layer is applied to said metallic layer and the thickness of said metallic oxide layer is between 30 and 100 microns.

11. The cooling element as claimed in claim 1, wherein the total layer thickness of said metallic layer and said metallic oxide layer is between 100 and 150 microns.

12. The cooling element as claimed in claim 1, wherein the silicon content varies between 2.2 and 3.5% by weight.

13. The cooling element as claimed in claim 1, wherein the carbon content with nodular graphite of the cast iron body is between 2.7 to 3.8% by weight.

14. The cooling element as claimed in claim 1, wherein the stable oxide is an oxide whose standard enthalpy of formation is less than −180 kcal at the temperature of 600° C. and normal pressure.

* * * * *